US008973683B2

(12) United States Patent
Cuillier De Maindreville et al.

(10) Patent No.: US 8,973,683 B2
(45) Date of Patent: Mar. 10, 2015

(54) HEAVY DUTY MATRIX BIT

(75) Inventors: Bruno Cuillier De Maindreville, Pau (FR); Williams Gomez, Bazet (FR)

(73) Assignee: Varel Europe S.A.S., Pau (FR)

( * ) Notice: Subject to any disclaimer, the term of this patent is extended or adjusted under 35 U.S.C. 154(b) by 345 days.

(21) Appl. No.: 13/476,662

(22) Filed: May 21, 2012

(65) Prior Publication Data

US 2012/0298425 A1 Nov. 29, 2012

Related U.S. Application Data

(60) Provisional application No. 61/489,056, filed on May 23, 2011.

(51) Int. Cl.

| | |
|---|---|
| ***E21B 10/42*** | (2006.01) |
| ***E21B 10/60*** | (2006.01) |
| ***B22F 7/08*** | (2006.01) |
| ***B22D 19/06*** | (2006.01) |
| ***B22F 5/00*** | (2006.01) |
| ***C22C 29/08*** | (2006.01) |
| ***E21B 10/00*** | (2006.01) |
| ***B22C 9/06*** | (2006.01) |
| ***B22D 19/14*** | (2006.01) |
| ***B22D 23/06*** | (2006.01) |

(52) U.S. Cl.

CPC . *B22F 7/08* (2013.01); *B22D 19/06* (2013.01); *B22F 5/00* (2013.01); *C22C 29/08* (2013.01); *E21B 10/00* (2013.01); *B22C 9/06* (2013.01); *B22D 19/14* (2013.01); *B22D 23/06* (2013.01)

USPC ..... 175/374; 175/425; 76/108.2

(58) Field of Classification Search

USPC ..... 175/331, 374, 425, 435; 76/108.2

See application file for complete search history.

(56) References Cited

U.S. PATENT DOCUMENTS

2009/0321146 A1 * 12/2009 Dick et al. ..... 175/371

FOREIGN PATENT DOCUMENTS

| | | |
|---|---|---|
| WO | 9813159 | 4/1998 |
| WO | 2008091793 | 7/2008 |
| WO | 2010078129 | 7/2010 |
| WO | 2011060406 | 5/2011 |

OTHER PUBLICATIONS

Galatioto, Maruska, International Search Report and Written Opinion of the International Searching Authority for PCT/IB2012/111095, Dec. 12, 2012, pp. 1-8.

* cited by examiner

*Primary Examiner* — William P Neuder

(74) *Attorney, Agent, or Firm* — King & Spalding LLP

(57) ABSTRACT

An apparatus and method for manufacturing a downhole tool that reduces failures occurring along a bondline between a cemented matrix coupled around a blank. The cemented matrix material is formed from a powder and a binder material. The blank includes an internal blank component and a coating coupled around at least a portion of the surface of the internal blank component. The internal blank component includes a top portion and a bottom portion. The internal blank component is substantially cylindrically shaped and defines a channel extending through the top portion and the bottom portion. The coating is a metal in some exemplary embodiments. The coating reduces the migration of the binder material into the blank thereby allowing the control of intermetallic compounds thickness within the bondline.

21 Claims, 5 Drawing Sheets

HEAVY DUTY MATRIX BIT

RELATED APPLICATIONS

The present application claims priority to U.S. Provisional Patent Application No. 61/489,056, entitled "Heavy Matrix Drill Bit" and filed on May 23, 2011, which is incorporated by reference herein.

BACKGROUND OF THE INVENTION

This invention relates generally to downhole tools and methods for manufacturing such items. More particularly, this invention relates to infiltrated matrix drilling products including, but not limited to, fixed cutter bits, polycrystalline diamond compact ("PDC") drill bits, natural diamond drill bits, thermally stable polycrystalline ("TSP") drill bits, bi-center bits, core bits, and matrix bodied reamers and stabilizers, and the methods of manufacturing such items.

Full hole tungsten carbide matrix drill bits for oilfield applications have been manufactured and used in drilling since at least as early as the 1940's. FIG. 1 shows a cross-sectional view of a downhole tool casting assembly 100 in accordance with the prior art. The downhole tool casting assembly 100 consists of a thick-walled mold 110, a stalk 120, one or more nozzle displacements 122, a blank 124, a funnel 140, and a binder pot 150. The downhole tool casting assembly 100 is used to fabricate a casting (not shown) of a downhole tool.

According to a typical downhole tool casting assembly 100, as shown in FIG. 1, and a method for using the downhole tool casting assembly 100, the thick-walled mold 110 is fabricated with a precisely machined interior surface 112, and forms a mold volume 114 located within the interior of the thick-walled mold 110. The thick-walled mold 110 is made from sand, hard carbon graphite, ceramic, or other known suitable materials. The precisely machined interior surface 112 has a shape that is a negative of what will become the facial features of the eventual bit face. The precisely machined interior surface 112 is milled and dressed to form the proper contours of the finished bit. Various types of cutters (not shown), known to persons having ordinary skill in the art, can be placed along the locations of the cutting edges of the bit and can also be optionally placed along the gage area of the bit. These cutters can be placed during the bit fabrication process or after the bit has been fabricated via brazing or other methods known to persons having ordinary skill in the art.

Once the thick-walled mold 110 is fabricated, displacements are placed at least partially within the mold volume 114 of the thick-walled mold 110. The displacements are typically fabricated from clay, sand, graphite, ceramic, or other known suitable materials. These displacements consist of the center stalk 120 and the at least one nozzle displacement 122. The center stalk 120 is positioned substantially within the center of the thick-walled mold 110 and suspended a desired distance from the bottom of the mold's interior surface 112. The nozzle displacements 122 are positioned within the thick-walled mold 110 and extend from the center stalk 120 to the bottom of the mold's interior surface 112. The center stalk 120 and the nozzle displacements 122 are later removed from the eventual drill bit casting so that drilling fluid (not shown) can flow though the center of the finished bit during the drill bit's operation.

The blank 124 is a cylindrical steel casting mandrel that is centrally suspended at least partially within the thick-walled mold 110 and around the center stalk 120. The blank 124 is positioned a predetermined distance down in the thick-walled mold 110. According to the prior art, the distance between the outer surface of the blank 124 and the interior surface 112 of the thick-walled mold 110 is typically 12 millimeters ("mm") or more so that potential cracking of the thick-walled mold 110 is reduced during the casting process.

Once the displacements 120, 122 and the blank 124 have been positioned within the thick-walled mold 110, tungsten carbide powder 130 is loaded into the thick-walled mold 110 so that it fills a portion of the mold volume 114 that is around the lower portion of the blank 124, between the inner surfaces of the blank 124 and the outer surfaces of the center stalk 120, and between the nozzle displacements 122. Shoulder powder 134 is loaded on top of the tungsten carbide powder 130 in an area located at both the area outside of the blank 124 and the area between the blank 124 and the center stalk 120. The shoulder powder 134 is made of tungsten powder or other known suitable material. This shoulder powder 134 acts to blend the casting to the steel blank 124 and is machinable. Once the tungsten carbide powder 130 and the shoulder powder 134 are loaded into the thick-walled mold 110, the thick-walled mold 110 is typically vibrated to improve the compaction of the tungsten carbide powder 130 and the shoulder powder 134. Although the thick-walled mold 110 is vibrated after the tungsten carbide powder 130 and the shoulder powder 134 are loaded into the thick-walled mold 110, the vibration of the thick-walled mold 110 can be done as an intermediate step before, during, and/or after the shoulder powder 134 is loaded on top of the tungsten carbide powder 130.

The funnel 140 is a graphite cylinder that forms a funnel volume 144 therein. The funnel 140 is coupled to the top portion of the thick-walled mold 110. A recess 142 is formed at the interior edge of the funnel 140, which facilitates the funnel 140 coupling to the upper portion of the thick-walled mold 110. Typically, the inside diameter of the thick-walled mold 110 is similar to the inside diameter of the funnel 140 once the funnel 140 and the thick-walled mold 110 are coupled together.

The binder pot 150 is a cylinder having a base 156 with an opening 158 located at the base 156, which extends through the base 156. The binder pot 150 also forms a binder pot volume 154 therein for holding a binder material 160. The binder pot 150 is coupled to the top portion of the funnel 140 via a recess 152 that is formed at the exterior edge of the binder pot 150. This recess 152 facilitates the binder pot 150 coupling to the upper portion of the funnel 140. Once the downhole tool casting assembly 100 has been assembled, a predetermined amount of binder material 160 is loaded into the binder pot volume 154. The typical binder material 160 is a copper alloy or other suitable known material. Although one example has been provided for setting up the downhole tool casting assembly 100, other examples can be used to form the downhole tool casting assembly 100.

The downhole tool casting assembly 100 is placed within a furnace (not shown) or other heating structure. The binder material 160 melts and flows into the tungsten carbide powder 130 through the opening 158 of the binder pot 150. In the furnace, the molten binder material 160 infiltrates the tungsten carbide powder 130 to fill the interparticle space formed between adjacent particles of tungsten carbide powder 130. During this process, a substantial amount of binder material 160 is used so that it fills at least a substantial portion of the funnel volume 144. This excess binder material 160 in the funnel volume 144 supplies a downward force on the tungsten carbide powder 130 and the shoulder powder 134. Once the binder material 160 completely infiltrates the tungsten carbide powder 130, the downhole tool casting assembly 100 is pulled from the furnace and is controllably cooled. Upon cooling, the binder material 160 solidifies and cements the particles of tungsten carbide powder 130 together into a coherent integral mass 310 (FIG. 3). The binder material 160 also bonds this coherent integral mass 310 (FIG. 3) to the steel blank 124 thereby forming a bonding zone 190, which is formed along at least a chamfered zone area 198 of the steel blank 124 and a central zone area 199 of the steel blank 124. The coherent integral mass 310 (FIG. 3) and the blank 124 collectively form the matrix body bit 200 (FIG. 2), a portion of which is shown in FIGS. 2 and 3. Once cooled, the thick-walled mold 110 is broken away from the casting. The casting then undergoes finishing steps which are known to persons having ordinary skill in the art, including the addition of a threaded connection (not shown) coupled to the top portion of the blank 124. Although the matrix body bit 200 (FIG. 2) has been described to be formed using the process and equipment described above, the process and/or the equipment can be varied to still form the matrix body bit 200 (FIG. 2).

FIG. 2 shows a magnified cross-sectional view of the bonding zone 190 located at the chamfered zone area 198 (FIG. 1) within the matrix body bit 200 in accordance with the prior art. FIG. 3 shows a magnified cross-sectional view of the bonding zone 190 located at the central zone area 199 (FIG. 1) within the matrix body bit 200 in accordance with the prior art. Referring to FIGS. 2 and 3, the coherent integral mass 310 is bonded to the steel blank 124 via the bonding zone 190 that is formed along the surface of the steel blank 124 and which extends inwardly into the interior portion of the steel blank 124. A portion of the binder material 160 diffuses into the steel blank 124 and reacts with the steel blank 124 to form this bonding zone 190. The bonding zone 190 includes intermetallic compounds 290. These intermetallic compounds 290 have an average hardness level of about 250 HV, which corresponds to about twice the hardness of the binder and steel matrix. According to FIG. 2, the bonding zone 190 is formed having a thickness 215 ranging from about sixty-five micrometers (μm) to about eighty μm in the chamfered zone area 198 (FIG. 1). According to FIG. 3, the bonding zone 190 is formed having a thickness 315 ranging from about ten μm to about twenty μm in the central zone area 199 (FIG. 1). The thicknesses 215, 315 and/or volumes of the bonding zone 190 are dependent upon the exposure time and the exposure temperature. Exposure temperature is related to the type of binder material 160 that is used to cement the tungsten carbide particles to one another. Manufacturers typically use the same binder material 160 over long periods of time, such as ten year or more, because of the knowledge gained with respect to the binder material 160 used. Thus, the exposure temperature is substantially the same from one casting to another. Exposure time is not always the same, but instead, is related to the bit diameter that is to be manufactured. When the bit diameter to be manufactured is relatively large, there is a larger volume of tungsten carbide particles that cemented to one another. Hence, the exposure time also is relatively longer, thereby providing more time for cementing the larger volume of tungsten carbide particles. Thus, since the exposure temperature is the same from one casting to another, and the exposure time is the same for casting similar bit diameters, it follows that the thicknesses 215, 315 of intermetallic compounds 290 formed within the bit is consistent from one casting to another for a same bit diameter.

Initially, natural diamond bits were used in oilfield applications. These natural diamond bits performed by grinding the rock within the wellbore, and not by shearing the rock. Thus, these natural diamond bits experienced little to no torque, and hence very little stress was experienced at the bonding zone 190 of the natural diamond bits. With the advent of PDC drill bits, the bits sheared the rock within the wellbore and began experiencing more torque. However, these initial PDC drill bits were fabricated relatively small, about six inch diameters to about 12¼ inch diameters, and the prior art fabrication method described above continued to perform well. Later, PDC drill bits were fabricated having larger diameters and failures began occurring along the bonding zone 190. Specifically, decohesion began occurring between the blank 124 and the coherent integral mass 310, or matrix, at the bonding zone 190. These intermetallic compounds 290 are a source for causing mechanical stresses to occur along the bonding zone 190 during drilling applications because there is a contraction of volume occurring when the intermetallic compounds 290 are formed. Now that cutter technology has improved, the demand placed upon the bits have also increased. Bits are being drilled for more hours. Bits also are being used with much more energy, which includes energy produced from increasing the weight on bit and/or from increasing the rotational speed of the bit. This increased demand on the bits is causing the decohesion failure to become a recurring problem in the industry. As the thickness or volume of the intermetallic compounds 290 increases, the risk of decohesion also increases.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

This invention relates generally to downhole tools and methods for manufacturing such items. More particularly, this invention relates to infiltrated matrix drilling products including, but not limited to, fixed cutter bits, polycrystalline diamond compact ("PDC") drill bits, natural diamond drill bits, thermally stable polycrystalline ("TSP") drill bits, bi-center bits, core bits, and matrix bodied reamers and stabilizers, and the methods of manufacturing such items. Although the description provided below is related to a drill bit, embodiments of the present invention relate to any infiltrated matrix drilling product.

Figure 1:
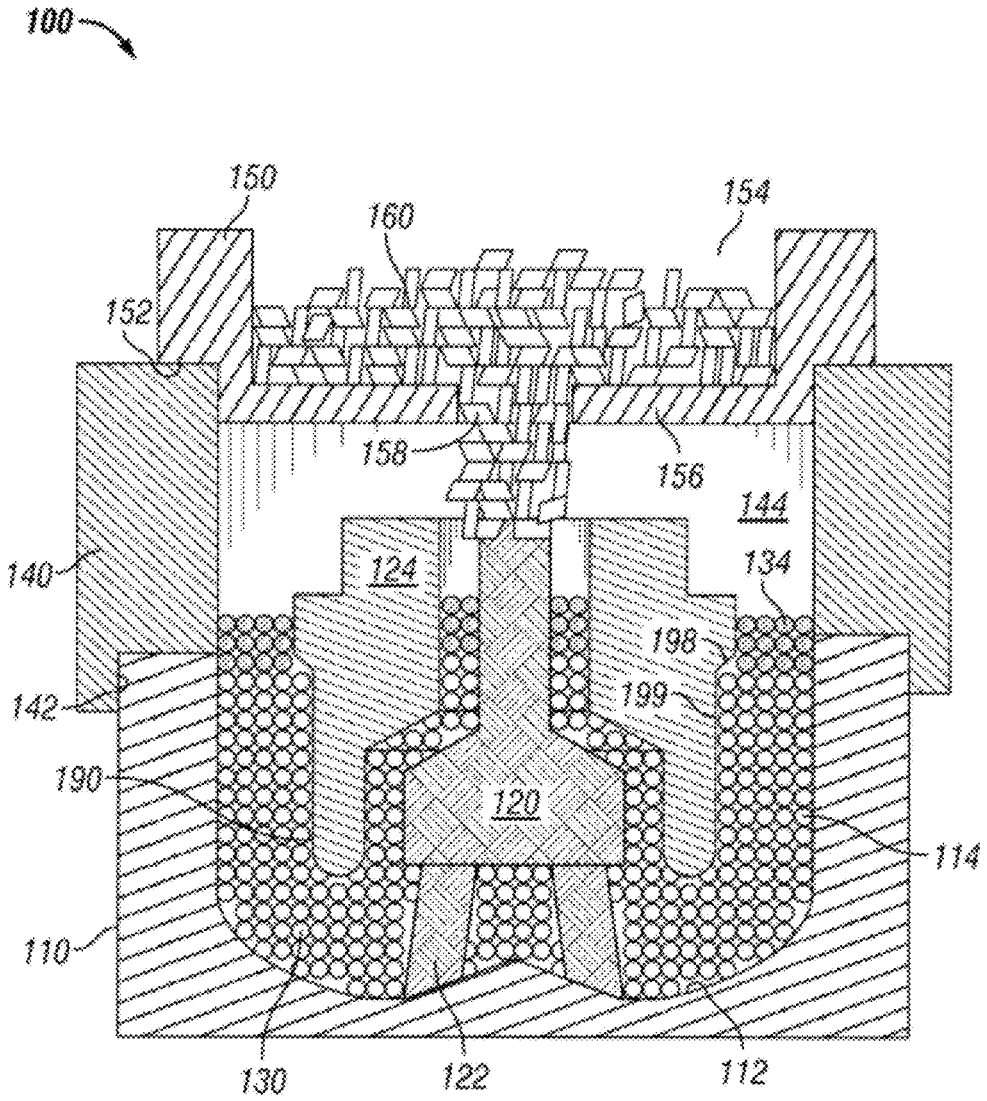
FIG. 1 (Prior Art)
FIG. 1 shows a cross-sectional view of a downhole tool casting assembly in accordance with the prior art.
Figure 4:
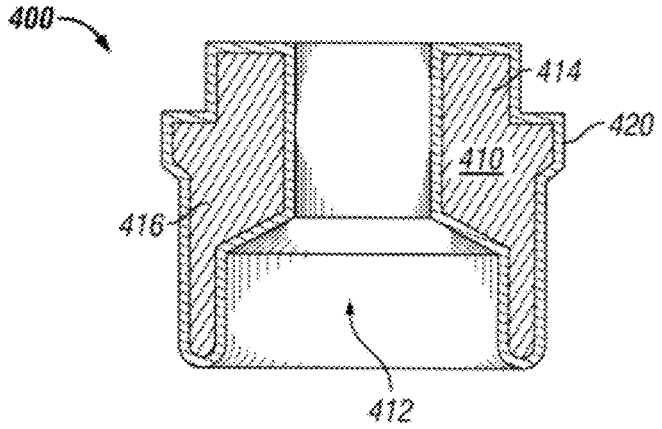
FIG. 4 shows a cross-sectional view of a blank in accordance with an exemplary embodiment.

FIG. 4 shows a cross-sectional view of a blank 400 in accordance with an exemplary embodiment. The blank 400 includes an internal blank component 410 and a metal coating 420 coupled around at least a portion of the surface of the internal blank component 410. The internal blank component 410 is similar to the blank 124 (FIG. 1) above. The internal blank component 410 is a cylindrically, hollow-shaped component and includes a cavity 412 extending through the entire length of the internal blank component 410. According to some exemplary embodiments the internal blank component 410 also includes a top portion 414 and a bottom portion 416. The top portion 414 has a smaller outer circumference than the bottom portion 416. According to some exemplary embodiments, the internal blank component 410 is fabricated from steel; however, any other suitable material known to people having ordinary skill in the art is used in other exemplary embodiments.

The metal coating 420 is applied onto at least a portion of the surface of the internal blank component 410. In some exemplary embodiments, the metal coating 420 is applied onto the surface of the entire internal blank component 410. In other exemplary embodiments, the metal coating 420 is applied onto a portion of the surface of the internal blank component 410. For example, the metal coating 420 is applied onto the surface of the bottom portion 416, which is the portion that bonds to the matrix material, or a coherent integral mass 710 (FIG. 7), which is described below. The metal coating 420 is applied onto the internal blank component 410 using electroplating techniques. Alternatively, other techniques, such as plasma spray, ion bombardment, electrochemical depositing, or other known coating techniques, are used to apply the metal coating 420 onto the internal blank component 410 in other exemplary embodiments. The metal coating 420 is fabricated using a material that reduces the formation of intermetallic compounds 690 (FIG. 6) along the surface of the blank 400 (FIG. 4). Specifically, the metal coating 420 reduces the migration of binder material 560 (FIG. 5) from the coherent integral mass 710 (FIG. 7) into the internal blank component 410 at the temperature and exposure time during the fabrication process. The metal coating 420 is fabricated from nickel according to some exemplary embodiments. Alternatively, the metal coating 420 is fabricated using at least one of brass, bronze, copper, aluminum, zinc, gold, molybdenum, a metal alloy of any previously mentioned metal, or any other suitable material that is capable of reducing the migration of binder material 560 (FIG. 5) into the internal blank component 410. Alternatively, a different type of coating, such as a polymer coating, is used in lieu of the metal coating.

The metal coating 420 is applied onto the internal blank component 410 having a thickness 422 ranging from about five μm to about 200 μm. In another exemplary embodiment, the metal coating 420 has a thickness 422 ranging from about five μm to about 150 μm. In yet another exemplary embodiment, the metal coating 420 has a thickness 422 ranging from about five am to about eighty μm. In a further exemplary embodiment, the metal coating 420 has a thickness 422 ranging less than or greater than the previously mentioned ranges. In certain exemplary embodiments, the thickness 422 is substantially uniform, while in other exemplary embodiments, the thickness 422 is non-uniform. For example, the thickness 422 is greater along the surface of the internal blank component 410 that would typically form a greater thickness of the intermetallic compound during the fabrication process, such as the chamfered zone area 598 (FIG. 5).

Figure 5:
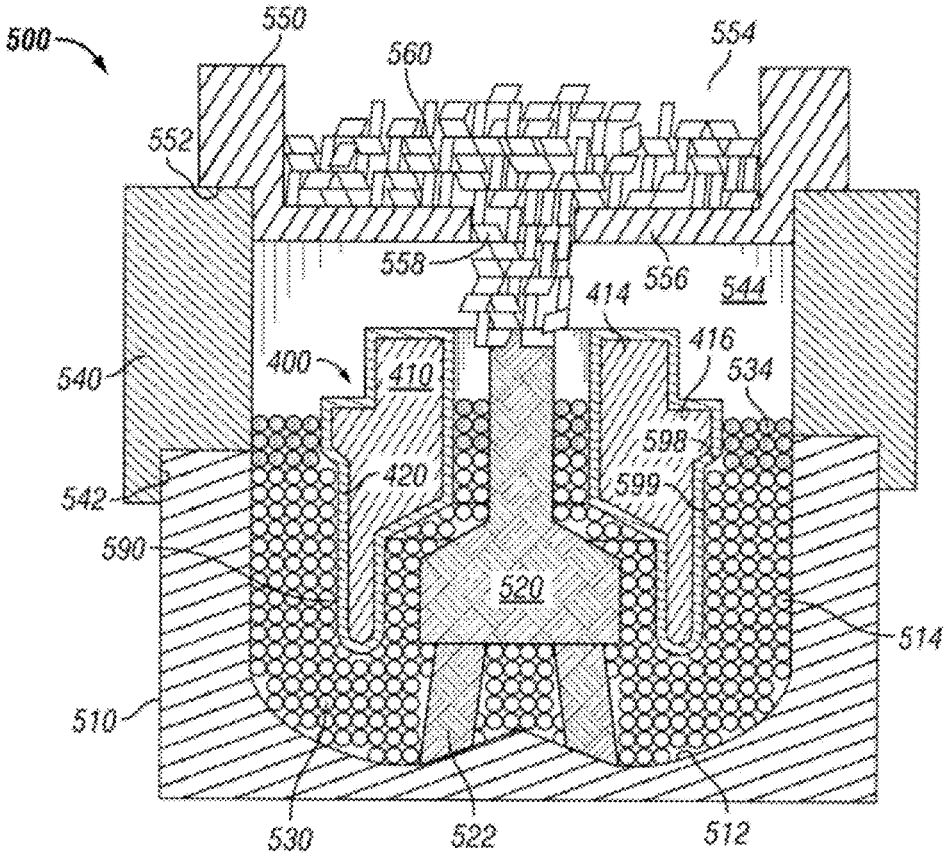
FIG. 5 shows a cross-sectional view of a downhole tool casting assembly using the blank of FIG. 4 in accordance with the exemplary embodiment.

FIG. 5 shows a cross-sectional view of a downhole tool casting assembly 500 using the blank 400 in accordance with the exemplary embodiment. Referring to FIG. 5, the downhole tool casting assembly 500 includes a mold 510, a stalk 520, one or more nozzle displacements 522, the blank 400, a funnel 540, and a binder pot 550. The downhole tool casting assembly 500 is used to fabricate a casting (not shown) of a downhole tool, such as a fixed cutter bit, a PDC drill bit, a natural diamond drill bit, and a TSP drill bit. However, the downhole tool casting assembly 500 is modified in other exemplary embodiments to fabricate other downhole tools, such as a bi-center bit, a core bit, and a matrix bodied reamer and stabilizer.

The mold 510 is fabricated with a precisely machined interior surface 512, and forms a mold volume 514 located within the interior of the mold 510. The mold 510 is made from sand, hard carbon graphite, ceramic, or other known suitable materials. The precisely machined interior surface 512 has a shape that is a negative of what will become the facial features of the eventual bit face. The precisely machined interior surface 512 is milled and dressed to form the proper contours of the finished bit. Various types of cutters (not shown), known to persons having ordinary skill in the art, are placed along the locations of the cutting edges of the bit and are optionally placed along the gage area of the bit. These cutters are placed during the bit fabrication process or after the bit has been fabricated via brazing or other methods known to persons having ordinary skill in the art.

Once the mold 510 is fabricated, displacements are placed at least partially within the mold volume 514. The displacements are fabricated from clay, sand, graphite, ceramic, or other known suitable materials. These displacements include the center stalk 520 and the at least one nozzle displacement 522. The center stalk 520 is positioned substantially within the center of the mold 510 and suspended a desired distance from the bottom of the mold's interior surface 512. The nozzle displacements 522 are positioned within the mold 110 and extend from the center stalk 520 to the bottom of the mold's interior surface 512. The center stalk 520 and the nozzle displacements 522 are later removed from the eventual drill bit casting so that drilling fluid (not shown) flows though the center of the finished bit during the drill bit's operation.

The blank 400, which has been previously described above, is centrally suspended at least partially within the mold 510 and around the center stalk 520. The blank 400 is positioned a predetermined distance down in the mold 510. The distance between the outer surface of the blank 400 and the interior surface 512 of the mold 510 is about twelve millimeters or more so that potential cracking of the mold 510 is reduced during the casting process. However, this distance is varied in other exemplary embodiments depending upon the strength of the mold 510 or the method and/or equipment used in fabricating the casting.

Once the displacements 520, 522 and the blank 400 have been positioned within the mold 510, tungsten carbide powder 530 is loaded into the mold 110 so that it fills a portion of the mold volume 514 that is around the bottom portion 416 of the blank 400, between the inner surfaces of the blank 400 and the outer surfaces of the center stalk 520, and between the nozzle displacements 522. Shoulder powder 534 is loaded on top of the tungsten carbide powder 530 in an area located at both the area outside of the blank 400 and the area between the blank 400 and the center stalk 520. The shoulder powder 534 is made of tungsten powder or other known suitable material. This shoulder powder 534 acts to blend the casting to the blank 400 and is machinable. Once the tungsten carbide powder 530 and the shoulder powder 534 are loaded into the mold 510, the mold 510 is vibrated, in some exemplary embodiments, to improve the compaction of the tungsten carbide powder 530 and the shoulder powder 534. Although the mold 510 is vibrated after the tungsten carbide powder 530 and the shoulder powder 534 are loaded into the mold 510, the vibration of the mold 510 is done as an intermediate step before, during, and/or after the shoulder powder 534 is loaded on top of the tungsten carbide powder 530. Although tungsten carbide material 530 is used in certain exemplary embodiments, other suitable materials known to persons having ordinary skill in the art is used in alternative exemplary embodiments.

The funnel 540 is a graphite cylinder that forms a funnel volume 544 therein. The funnel 540 is coupled to the top portion of the mold 510. A recess 542 is formed at the interior edge of the funnel 540, which facilitates the funnel 540 coupling to the upper portion of the mold 510. In some exemplary embodiments, the inside diameter of the mold 510 is similar to the inside diameter of the funnel 540 once the funnel 540 and the mold 510 are coupled together.

The binder pot 550 is a cylinder having a base 556 with an opening 558 located at the base 556, which extends through the base 556. The binder pot 550 also forms a binder pot volume 554 therein for holding a binder material 560. The binder pot 550 is coupled to the top portion of the funnel 540 via a recess 152 that is formed at the exterior edge of the binder pot 550. This recess 552 facilitates the binder pot 550 coupling to the upper portion of the funnel 540. Once the downhole tool casting assembly 500 has been assembled, a predetermined amount of binder material 560 is loaded into the binder pot volume 554. The typical binder material 560 is a copper alloy or other suitable known material. Although one example has been provided for setting up the downhole tool casting assembly 500, other examples having greater, fewer, or different components are used to form the downhole tool casting assembly 500. For instance, the mold 510 and the funnel 540 are combined into a single component in some exemplary embodiments.

Figure 6:
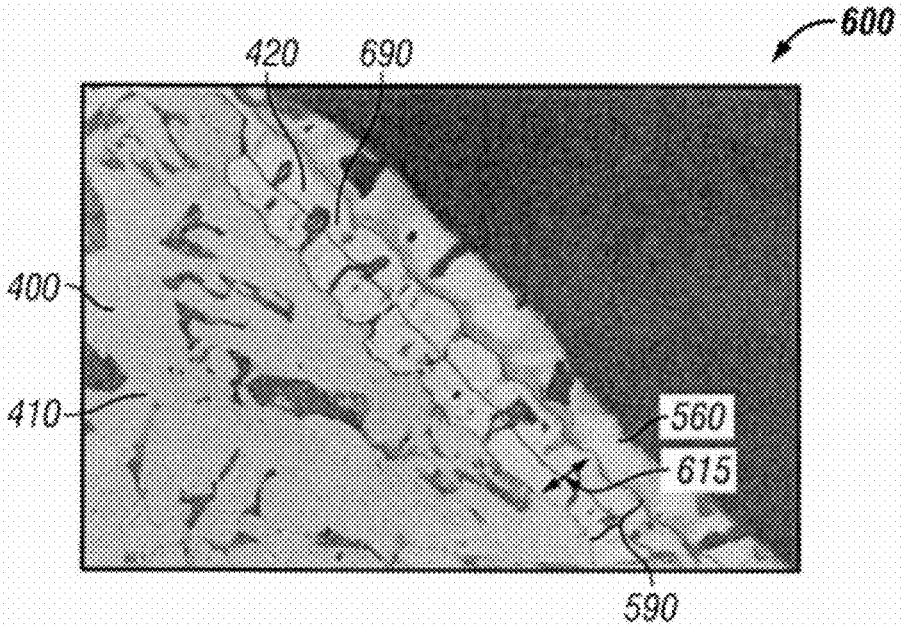
FIG. 6 shows a magnified cross-sectional view of a bonding zone located at a chamfered zone area within the downhole tool in accordance with the exemplary embodiment.
Figure 7:
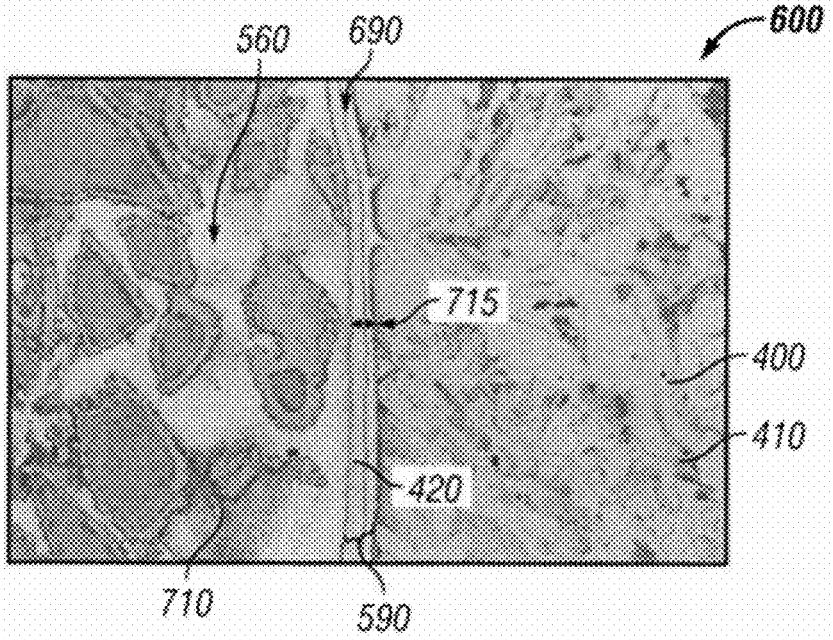
FIG. 7 shows a magnified cross-sectional view of a bonding zone located at a central zone area within the downhole tool in accordance with the exemplary embodiment.

The downhole tool casting assembly 500 is placed within a furnace (not shown) or other heating structure. The binder material 560 melts and flows into the tungsten carbide powder 530 through the opening 558 of the binder pot 550. In the furnace, the molten binder material 560 infiltrates the tungsten carbide powder 530 to fill the interparticle space formed between adjacent particles of tungsten carbide powder 530. During this process, a substantial amount of binder material 560 is used so that it fills at least a substantial portion of the funnel volume 544. This excess binder material 560 in the funnel volume 544 supplies a downward force on the tungsten carbide powder 530 and the shoulder powder 534. Once the binder material 560 completely infiltrates the tungsten carbide powder 530, the downhole tool casting assembly 500 is pulled from the furnace and is controllably cooled. Upon cooling, the binder material 560 solidifies and cements the particles of tungsten carbide powder 530 together into a coherent integral mass 710 (FIG. 7). The binder material 560 also bonds this coherent integral mass 710 (FIG. 7) to the blank 400 thereby forming a bonding zone 590, which is formed at least at a chamfered zone area 598 of the blank 400 and a central zone area 599 of the blank 400, according to certain exemplary embodiments. The coherent integral mass 710 (FIG. 7) and the blank 400 collectively form the matrix body bit 600 (FIG. 6), a portion of which is shown in FIGS. 6 and 7. Once cooled, the mold 510 is broken away from the casting. The casting then undergoes finishing steps which are known to persons of ordinary skill in the art, including the addition of a threaded connection (not shown) coupled to the top portion 414 of the blank 400. Although the matrix body bit 600 (FIG. 6) has been described to be formed using the process and equipment described above, the process and/or the equipment can be varied to still form the matrix body bit 600 (FIG. 6).

Figure 2:
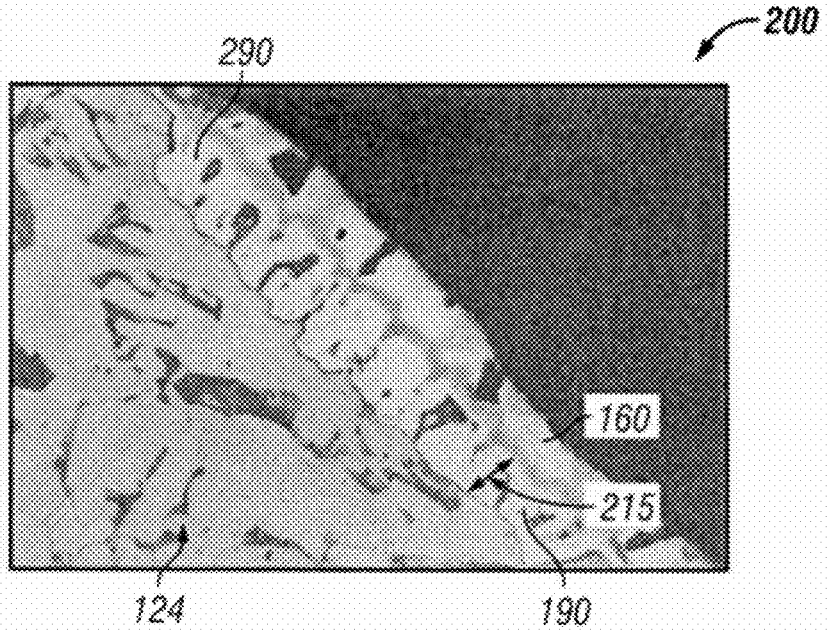
FIG. 2 (Prior Art)
FIG. 2 shows a magnified cross-sectional view of a bonding zone located at a chamfered zone area within the matrix body bit in accordance with the prior art.
Figure 3:
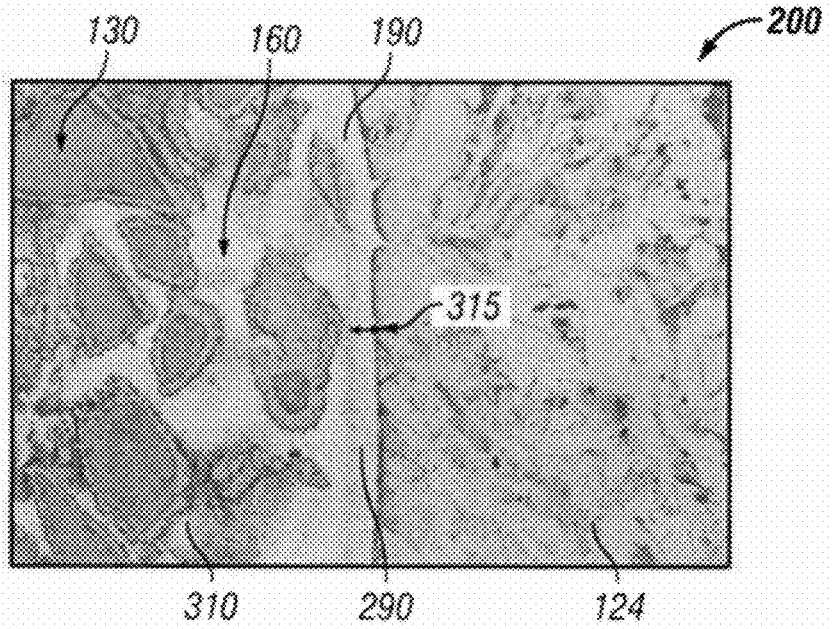
FIG. 3 (Prior Art)
FIG. 3 shows a magnified cross-sectional view of a bonding zone located at a central zone area within the matrix body bit in accordance with the prior art.

FIG. 6 shows a magnified cross-sectional view of the bonding zone 590 located at the chamfered zone area 598 (FIG. 5) within the downhole tool in accordance with the exemplary embodiment. FIG. 7 shows a magnified cross-sectional view of the bonding zone 590 located at the central zone area 599 (FIG. 5) within the downhole tool in accordance with the exemplary embodiment. Referring to FIGS. 6 and 7, the blank 400 includes the internal blank component 410 and the metal coating 420, which is applied onto the surface of the internal blank component 410. The coherent integral mass 710 is bonded to the blank 400 via the bonding zone 590 that is formed along the surface of the blank 400 and which extends inwardly into the interior portion of the blank 400. According to some exemplary embodiments, the metal coating 420 is thinly applied onto the internal blank component 410 so that a portion of the binder material 560 diffuses into both the metal coating 420 and the internal blank component 410 and reacts with the metal coating 420 and a portion of the internal blank component 410 to form this bonding zone 590. The bonding zone 590 includes intermetallic compounds 690, which are similar to the intermetallic compounds 290 (FIG. 2). According to FIG. 6, the bonding zone 590 is formed having a thickness 615 ranging from about five μm to less than sixty-five μm in the chamfered zone area 598 (FIG. 5). In another exemplary embodiment, the bonding zone 590 is formed having a thickness 615 ranging from about five μm to less than fifty μm in the chamfered zone area 598 (FIG. 5). In yet another exemplary embodiment, the bonding zone 590 is formed having a thickness 615 ranging from about five μm to less than thirty μm in the chamfered zone area 598 (FIG. 5). According to FIG. 7, the bonding zone 590 is formed having a thickness 715 ranging from about two μm to less than about ten μm in the central zone area 599 (FIG. 5). In another exemplary embodiment, the bonding zone 590 is formed having a thickness 715 ranging from about two μm to less than eight μm in the central zone area 599 (FIG. 5). In yet another exemplary embodiment, the bonding zone 590 is formed having a thickness 715 ranging from about two μm to less than six μm in the central zone area 599 (FIG. 5). The thicknesses 615, 715 and/or volumes of the bonding zone 590 are dependent upon the exposure time, the temperature, and the thickness of the metal coating 420 that is applied onto the internal blank component 410. As previously mentioned, the metal coating 420 reduces the migration of binder material 560 from the coherent integral mass 710 into the blank 400 during the fabrication process.

Figure 8:
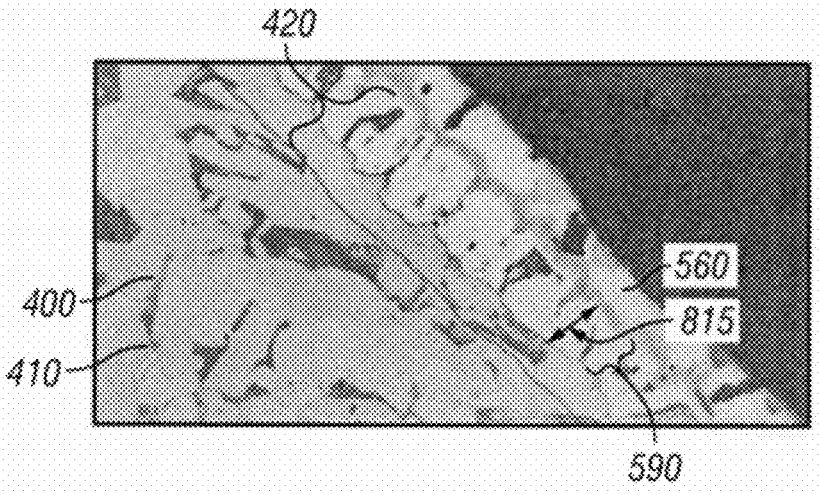
FIG. 8 shows a magnified cross-sectional view of a bonding zone located at a chamfered zone area within the downhole tool in accordance with another exemplary embodiment.
Figure 9:
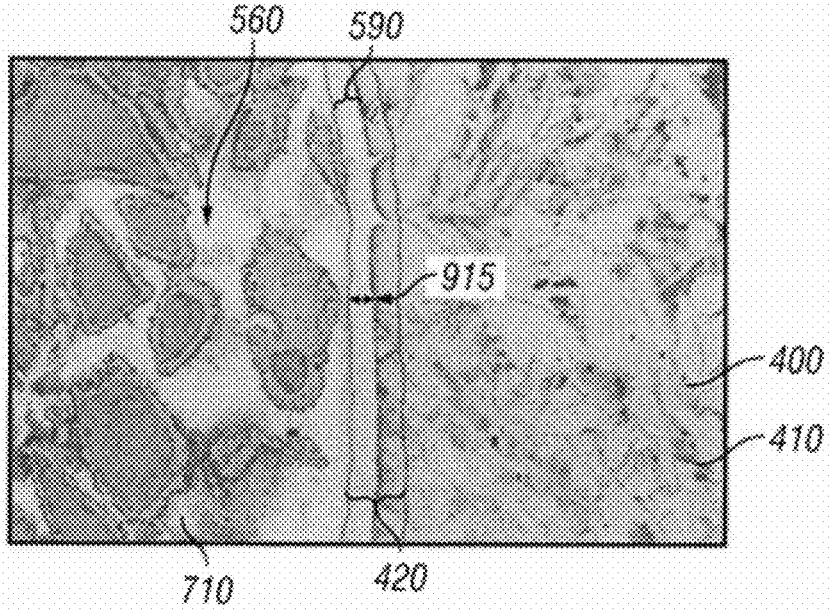
FIG. 9 shows a magnified cross-sectional view of a bonding zone located at a central zone area within the downhole tool in accordance with another exemplary embodiment.

FIG. 8 shows a magnified cross-sectional view of the bonding zone 590 located at the chamfered zone area 598 (FIG. 5) within the downhole tool in accordance with another exemplary embodiment. FIG. 9 shows a magnified cross-sectional view of the bonding zone 590 located at the central zone area 599 (FIG. 5) within the downhole tool in accordance with another exemplary embodiment. Referring to FIGS. 8 and 9, the blank 400 includes the internal blank component 410 and the metal coating 420, which is applied onto the surface of the internal blank component 410. The coherent integral mass 710 is bonded to the blank 400 via the bonding zone 590 that is formed along the surface of the blank 400 and which extends inwardly into the interior portion of the blank 400. According to some exemplary embodiments, the metal coating 420 is applied onto the internal blank component 410 such that a portion of the binder material 560 diffuses into a portion of the metal coating 420 but not into the internal blank component 410. The diffused binder material 560 reacts with a portion of the metal coating 420 to form this bonding zone 590. The bonding zone 590 includes intermetallic compounds 690, which are similar to the intermetallic compounds 290 (FIG. 2). According to FIG. 8, the bonding zone 590 is formed having a thickness 815 ranging from about five μm to less than sixty-five μm in the chamfered zone area 598 (FIG. 5). In another exemplary embodiment, the bonding zone 590 is formed having a thickness 815 ranging from about five μm to less than fifty μm in the chamfered zone area 598 (FIG. 5). In yet another exemplary embodiment, the bonding zone 590 is formed having a thickness 815 ranging from about five μm to less than thirty μm in the chamfered zone area 598 (FIG. 5). According to FIG. 9, the bonding zone 590 is formed having a thickness 915 ranging from about two μm to less than about ten μm in the central zone area 599 (FIG. 5). In another exemplary embodiment, the bonding zone 590 is formed having a thickness 915 ranging from about two μm to less than eight μm in the central zone area 599 (FIG. 5). In yet another exemplary embodiment, the bonding zone 590 is formed having a thickness 915 ranging from about two μm to less than six μm in the central zone area 599 (FIG. 5). The thicknesses 815, 915 and/or volumes of the bonding zone 590 are dependent upon the exposure time, the temperature, and the thickness of the metal coating 420 that is applied onto the internal blank component 410. As previously mentioned, the metal coating 420 reduces the migration of binder material 560 from the coherent integral mass 710 into the blank 400 during the fabrication process.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A downhole tool, comprising:

a metal component comprising a central zone surface;

a coating on said metal component;

a cemented matrix material comprising a binder material cementing a powder material therein, the cemented matrix material bonded to the central zone surface; and a bonding zone between said coating and said cemented matrix material, wherein the bonding zone comprises a plurality of intermetallic compounds, the plurality of intermetallic compounds having a thickness ranging from about two microns to less than ten microns.

2. The downhole tool of claim 1, wherein the thickness of the plurality of intermetallic compounds at the central zone surface ranges from about two microns to less than about eight microns.

3. The downhole tool of claim 1, wherein the thickness of the plurality of intermetallic compounds at the central zone surface ranges from about two microns to less than about six microns.

4. The downhole tool of claim 1, wherein the metal component further comprises a chamfered zone surface and wherein said downhole tool further comprises a second bonding zone, said second bonding zone between said coating and said cemented matrix material at the chamfered zone surface, the second bonding zone comprising a second plurality of intermetallic compounds, the second plurality of intermetallic compounds having a thickness ranging from about five microns to less than sixty-five microns.

5. The downhole tool of claim 4, wherein the thickness of the second plurality of intermetallic compounds at the chamfered zone surface ranges from about five microns to less than about fifty microns.

6. The downhole tool of claim 4, wherein the thickness of the second plurality of intermetallic compounds at the chamfered zone surface ranges from about five microns to less than about thirty microns.

7. The downhole tool of claim 4, wherein the metal component further comprises:

an internal blank component being substantially cylindrically shaped and defining a channel extending therethrough, wherein the second plurality of intermetallic compounds is formed through a portion of the thickness of the coating.

8. The downhole tool of claim 4, wherein the metal component further comprises:

an internal blank component being substantially cylindrically shaped and defining a channel extending therethrough, wherein the second plurality of intermetallic compounds is formed through the thickness of the coating and a portion of the thickness of the internal blank component.

9. The downhole tool of claim 1, wherein the metal component further comprises:

an internal blank component being substantially cylindrically shaped and defining a channel extending therethrough, wherein the plurality of intermetallic compounds is formed through a portion of the thickness of the coating.

10. The downhole tool of claim 1, wherein the metal component further comprises:

an internal blank component being substantially cylindrically shaped and defining a channel extending therethrough, wherein the plurality of intermetallic compounds is formed through the thickness of the coating and a portion of the thickness of the internal blank component.

11. A downhole tool, comprising:

an internal blank;

a coating coupled to said internal blank;

a matrix material bonded to said internal blank; and a bonding zone between said internal blank and said matrix material, said bonding zone resulting from the reaction between said matrix material and said coating.

12. The downhole tool of claim 11, wherein said bonding zone comprises an intermetallic compound.

13. The downhole tool of claim 12, wherein said coating comprises metal.

14. The downhole tool of claim 13, wherein the metal is selected from the group consisting of nickel, brass, bronze, copper, aluminum, zinc, gold, molybdenum, and metal alloys formed therefrom.

15. The downhole tool of claim 12, wherein the coating disposed on said internal blank comprises a polymer.

16. The downhole tool of claim 11, wherein said internal blank comprises a central zone, wherein said intermetallic compound in said central zone has a thickness ranging from about two microns to less than ten microns.

17. The downhole tool of claim 16, wherein said internal blank comprises a chamfer zone and wherein said intermetallic compound in said chamfer zone has a thickness ranging from about five microns to less than sixty-five microns.

18. The downhole tool of claim 11, wherein said matrix material is a cemented mass of binder material and tungsten carbide powder.

19. The downhole tool of claim 18, wherein said binder material bonds said matrix material to said coating.

20. The downhole tool of claim 18, wherein said binder material bonds said matrix material to said internal blank.

21. The downhole tool of claim 11 wherein said coating before said matrix material is bonded to said internal blank has a thickness ranging from about five microns to less than 200 microns.

* * * * *